US011259656B2

(12) United States Patent
Garfield et al.

(10) Patent No.: US 11,259,656 B2
(45) Date of Patent: Mar. 1, 2022

(54) SUPPORT PILLOW

(71) Applicants: Marion Garfield, New York, NY (US); Carolyn Gang, White Plains, NY (US)

(72) Inventors: Marion Garfield, New York, NY (US); Carolyn Gang, White Plains, NY (US)

(73) Assignee: CosMed Pillow, LLC, White Plains, NY (US)

( * ) Notice: Subject to any disclaimer, the term of this patent is extended or adjusted under 35 U.S.C. 154(b) by 186 days.

(21) Appl. No.: 15/660,654

(22) Filed: Jul. 26, 2017

(65) Prior Publication Data

US 2018/0042410 A1 Feb. 15, 2018

Related U.S. Application Data

(60) Provisional application No. 62/036,222, filed on Aug. 14, 2014.

(51) Int. Cl.
*A47G 9/10* (2006.01)

(52) U.S. Cl.
CPC ..... *A47G 9/1081* (2013.01)

(58) Field of Classification Search
CPC ..... A47G 9/10; A47G 9/1045; A47G 9/1081; A47G 9/109
See application file for complete search history.

(56) References Cited

U.S. PATENT DOCUMENTS

D187,313 S 2/1960 Denver
D189,072 S 10/1960 Baisch
3,088,139 A 5/1963 Carroll
D241,993 S 10/1976 Marks
4,091,481 A * 5/1978 Redman ..... A47G 9/1045 206/83
D289,075 S 3/1987 Wolfe
D290,108 S 6/1987 Wolfe
5,103,516 A * 4/1992 Stevens ..... A47C 20/021 5/632
5,528,784 A * 6/1996 Painter ..... A47G 9/10 5/636
D373,275 S 9/1996 Bell
D381,232 S 7/1997 Jansson
5,765,502 A 6/1998 Haugh
D399,350 S 10/1998 Hudson
D399,675 S 10/1998 Ferris
6,003,177 A * 12/1999 Ferris ..... A61F 5/01 5/636
6,006,381 A * 12/1999 Tandrup ..... A47D 13/08 5/637

(Continued)

*Primary Examiner* — Peter M. Cuomo
*Assistant Examiner* — Ifeolu A Adeboyejo
(74) *Attorney, Agent, or Firm* — Christopher J. Capelli

(57) ABSTRACT

A shaped support pillow for supporting the head while promoting a back-resting position, The support pillow having a base portion having opposing front and rear edge portions wherein a central portion of the base portion is configured to support against the back of a person's head and wherein a front edge portion is configured to support against the top of the shoulder area of a person. The support pillow further includes first and second opposing supporting members extending from opposing side portions of the base portion configured to envelope and support the back side region of a person's head and neck while limiting the turning of the head.

9 Claims, 4 Drawing Sheets

(56) References Cited

U.S. PATENT DOCUMENTS 6,095,894 A * 8/2000 Stevens ..... A41D 13/0575 2/267
D433,826 S 11/2000 Linder
D450,470 S 11/2001 Perez
D476,185 S 6/2003 Siegal
6,763,539 B1 7/2004 Bartley
6,779,211 B1 8/2004 Williams
7,100,227 B2 9/2006 Frisbee
D535,063 S 1/2007 Green
7,165,279 B1 * 1/2007 Georgescu ..... A47G 9/10 5/490
D545,407 S 6/2007 Chiu
D561,861 S 2/2008 Boutin
D588,390 S 3/2009 Brill-Cass
D597,364 S 8/2009 Lindgren
D618,943 S 7/2010 Gold
7,975,336 B1 * 7/2011 Perry ..... A47C 20/027 5/636
8,893,334 B1 * 11/2014 Wong ..... A47G 9/109 5/622
D744,262 S 12/2015 Waugh
9,414,698 B2 8/2016 Sheeler-Johnson
D782,593 S 3/2017 Osimo
D787,232 S 5/2017 Kassab Arabo
9,775,452 B2 10/2017 Gibbons
D807,653 S 1/2018 Roizner
D818,653 S 5/2018 Song
D853,152 S 7/2019 Chen
D858,143 S 9/2019 Tu
D863,828 S 10/2019 Smith
2002/0112290 A1 * 8/2002 Stevens ..... A47C 20/023 5/640
2005/0262637 A1 * 12/2005 Funatogawa ..... A47G 9/10 5/636
2006/0123547 A1 * 6/2006 Ferber ..... A47G 9/0253 5/636
2009/0001801 A1 1/2009 Gold
2010/0175192 A1 7/2010 Aiken
2012/0174320 A1 * 7/2012 White Thomas .... A47G 9/1036 5/632
2012/0186022 A1 * 7/2012 Navarro ..... A47G 9/10 5/644
2013/0333117 A1 * 12/2013 Shamaiengar ..... A47C 7/383 5/640
2015/0289687 A1 * 10/2015 Day ..... A47G 9/1045 5/490
2016/0073801 A1 * 3/2016 Shin ..... A47G 9/1045 5/636
2016/0073803 A1 3/2016 Sheeler-Johnson
2016/0345760 A1 * 12/2016 Pesale ..... A47G 9/109
2017/0042352 A1 * 2/2017 Atkinson ..... A47G 9/1081
2019/0045950 A1 2/2019 Smith

* cited by examiner

SUPPORT PILLOW

COPYRIGHT NOTICE

A portion of the disclosure of this patent document contains material which is subject to copyright protection. The copyright owner has no objection to the facsimile reproduction by any one of the patent disclosure, as it appears in the U.S. Patent and Trademark Office patent files or records, but otherwise reserves all copyright rights whatsoever.

FIELD OF THE INVENTION

The present invention relates to a neck and head support pillow for supporting and resting the head and neck while promoting a back sleeping position.

BACKGROUND OF THE INVENTION

A multitude of differently shaped pillows have been proposed to support the head and neck during rest and sleep. A pillow specially contoured to fit the natural shape of the head and neck with proper firmness and support in order to promote and maintain a certain body position with comfort is beneficial for good health, healing and proper rest. A multi-use pillow shaped to provide support to the head and neck during rest and sleep, comfortably promoting a face-up position so that there is no direct pressure on the facial area, as well as promoting and maintaining a comfortable back-sleeping position, keeping the front areas of the body free from pressure.

A comfortable supportive back-sleeping position is of particular relevance for men and women for both medical and cosmetic purposes. The benefits from the function of this design which promotes back sleeping are indicated in but not limited to the various applications mentioned. Further benefits include preventing and/or minimizing formation of facial wrinkles typically caused by nightly pressure creases. It contributes to the healing process for post facial cosmetic and/or reconstructive procedures. Beneficial post ophthalmologic and cataract surgery, for certain post orthopedic procedures, and surgeries not limited to shoulder, neck, hips, back or knees, after cosmetic and/or reconstructive breast surgery, breathing related issues, and others. A face-up, back-sleeping position by preventing pressure on the compromised areas of the face or body can help alleviate pain and promote sealing. The pillow benefits the user who otherwise without its comfortable supportive elements, could move into an unsuitable position during the unconscious arrangement of the body during sleep or rest. Its shape and elements support and help maintain the back sleeping position in a comfortable manner.

SUMMARY OF THE INVENTION

The purpose and advantages of the below described illustrated embodiments will be set forth in and apparent from the description that follows. Additional advantages of the illustrated embodiments will be realized and attained by the devices, systems and methods particularly pointed out in the written description and claims hereof, as well as from the appended drawings.

To achieve these and other advantages and in accordance with the purpose of the illustrated embodiments, in one aspect, disclosed is a uniquely shaped pillow whose form is an integral part of its multipurpose function. Its unique shape comfortably supports a head position so as to particularly promote sleeping on one's back. Advantages include facilitating a preventative and/or healing environment for multiple cosmetic and medical applications for which back sleeping is preferable.

In accordance with an illustrated embodiment, the present invention pillow is unique in shape and silhouette. It is contoured and rounded following the natural shape of the head and neck, flaring at the base to the top of the shoulder area. Two padded, crescent-shaped, supportive side members are strategically attached at an angle to either side of the pillow top. These supportive side members can be referred to as cushions, bumpers, panels and the like. They are configured to gently envelope the sides and back of the head, particularly for supporting maintaining a back-sleeping position. Preferably, these side members are padded and soft, yet firm and sturdy enough to support the sideways movement of the head so it remains in an upright, restful position. The filler for the pillow and its appendages is preferably a hypoallergenic polyester. It is preferably covered with a cotton/polyester fabric. It is to be appreciated other fabrics may be used as well, as well as other fillers that may be deemed appropriate for the pillow's function.

Exemplary noted advantages of the present invention in accordance with one or more of the illustrated embodiments includes facilitating a back sleeping face-up position which provides preventative and/or healing benefits for cosmetic skin procedures, such as laser resurfacing, dermabrasion, acid peels, and the like. It promotes smoother skin by either preventing or minimizing repeated facial pressure creases which become over time deep wrinkles. It reduces eye puffiness and bags. It is beneficial for eyelid surgery for either cosmetic or medical reasons, including for instance chin surgeries, implants and rhinoplasty (including facial plastic surgery or reconstructive surgery and any other cosmetic surgery application and the like). Other advantageous applications include use after surgical procedures, orthopedic or otherwise, where back sleeping is desired. The present invention pillow is additionally beneficial for post sinus surgery, breast surgery, dental or mouth surgery and facial related surgeries. Generally it is to be understood and appreciated the present invention pillow is configured for use by a person who desires back sleeping/resting for any reason at any age.

This summary section is provided to introduce a selection of concepts in a simplified form that are further described subsequently in the detailed description section. This summary section is not intended to identify key features or essential features of the claimed subject matter, nor is it intended to be used to limit the scope of the claimed subject matter.

BRIEF DESCRIPTION OF THE DRAWINGS

The accompanying appendices and/or drawings illustrate various non-limiting, example, inventive aspects in accordance with the present disclosure.

DETAILED DESCRIPTION OF CERTAIN EMBODIMENTS

Figure 1:
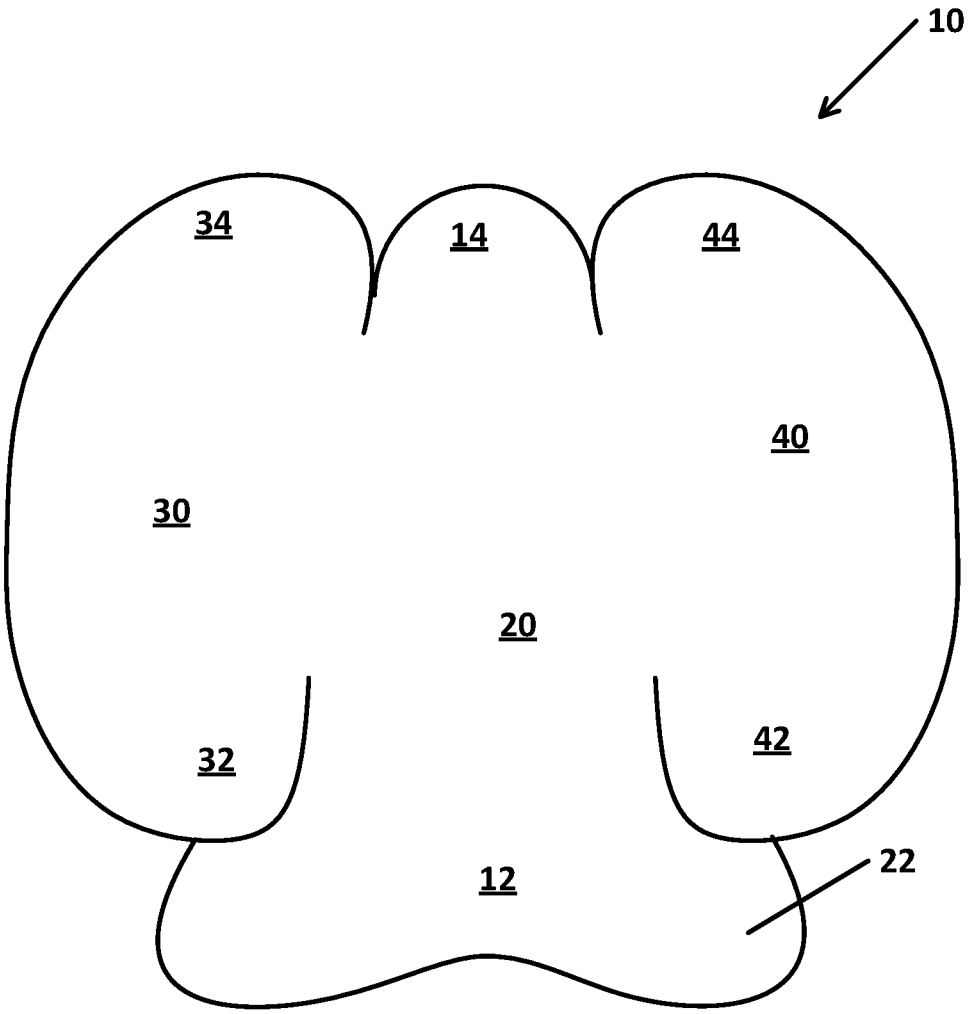
FIG. 1 is a top planar view of the present invention support pillow in accordance with an illustrated embodiment.

The illustrated embodiments are now described more fully with reference to the accompanying drawings wherein like reference numerals identify similar structural/functional features. The illustrated embodiments are not limited in any way to what is illustrated as the illustrated embodiments described below are merely exemplary, which can be embodied in various forms, as appreciated by one skilled in the art. Therefore, it is to be understood that any structural and functional details disclosed herein are not to be interpreted as limiting, but merely as a basis for the claims and as a representation for teaching one skilled in the art to variously employ the discussed embodiments. Furthermore, the terms and phrases used herein are not intended to be limiting but rather to provide an understandable description of the illustrated embodiments.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the illustrated embodiments, exemplary methods and materials are now described. It must be noted that as used herein and in the appended claims, the singular forms "a" "an," and "the" include plural referents unless the context clearly dictates otherwise.

Figure 2:
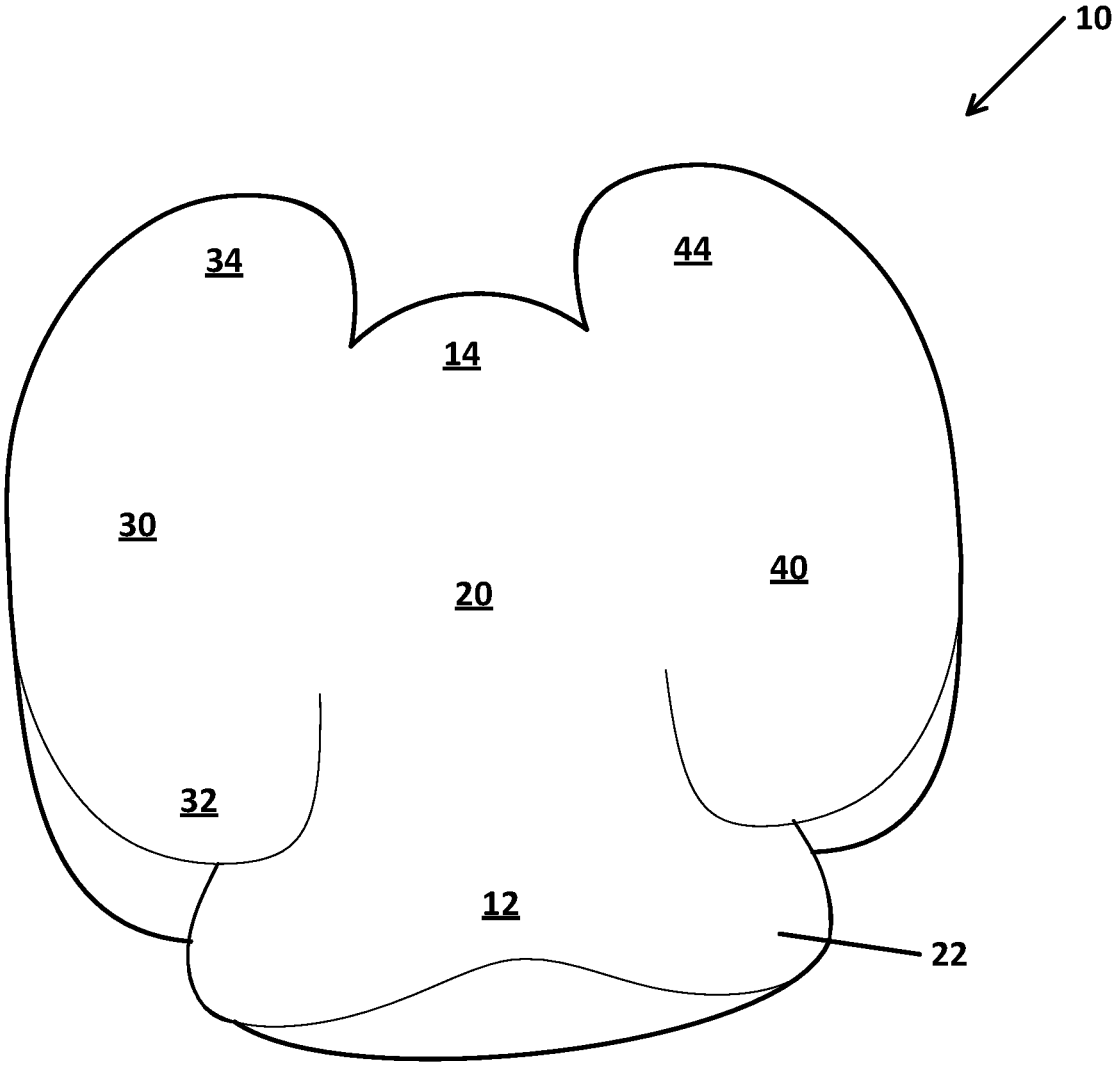
FIG. 2 is a top perspective view from a front edge portion of the support pillow of FIG. 1.
Figure 3:
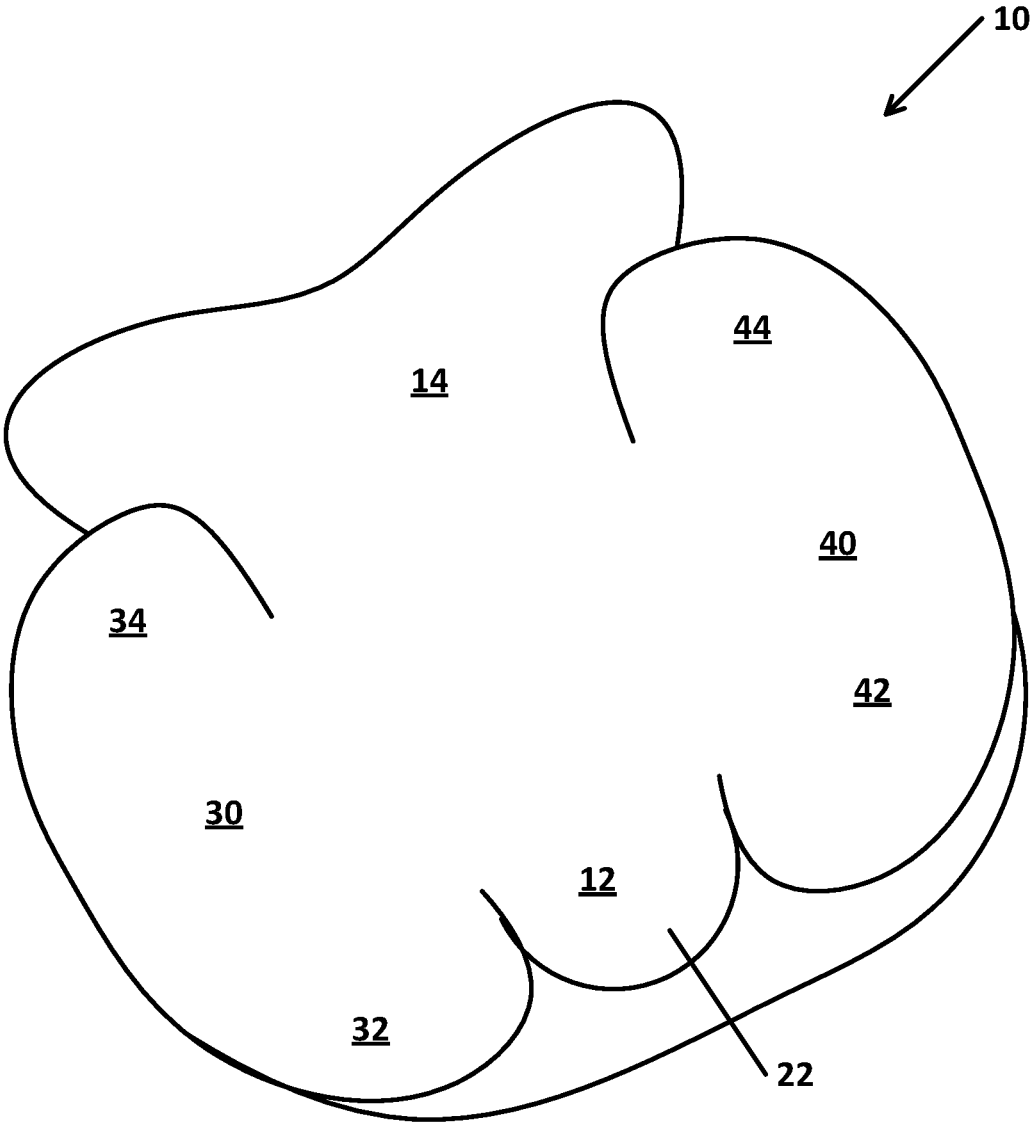
FIG. 3 is a top perspective view from a rear edge portion of the support pillow of FIG. 1.

An illustrated embodiment of the present invention support pillow is shown in FIG. 1-3 preferably consisting a head support pillow 10, constructed and configured for supporting the head of a person lying on a sleep surface (e.g., a pillow, mattress or any other surface a person may rest their head upon). As shown in FIGS. 1-3, the support pillow 10 preferably consists of a central base portion 20 and two oppositely and parallel arranged head side support members 30, 40 forming in-between them a head support region for supporting the head of a person lying on their back. As shown in FIG. 1, the head support member is defined by a front edge portion 12 and a rear edge portion 14. It is to be understood the front edge, portion 12 is configured to support the upper neck/bottoms head portion of a person while the rear edge portion 14 is configured to be disposed in proximity to the top head portion of a person while tying on a back position. The head support members 30, 40 are generally configured to envelope the side and back of the head for supporting and maintaining back-sleeping position.

As further described below, generally the present invention pillow 10 has a contoured and rounded shape configured to accommodate (follow) the natural shape of a head and neck portion of a person. As shown in FIG. 1, the front edge portion 12 flares its base portion to accommodate the top of the shoulder portion of a person. The two head support members 30, 40 angularly extending from the base portion 20 are specifically angled (relative to the base portion 20) for securely, and comfortably, supporting the back head portion of a person while in a back-sleeping or lying position. More specifically, the head support members 30, 40 are configured and angularly extend from the base portion 20 to support sideways movement of the head so it remains in an upright, restful position of a person while in a back-sleeping or lying position.

In the illustrated embodiment of FIG. 1, the present invention pillow 10 is a unitary structure having an inner cavity portion filled with a suitable filler material, such as an hypoallergenic polyester material, gel or any other suitable filler material providing a padded soft support surface while also providing firmness functional enough to support sideways movement of a head so it remains in an upright, restful position. Alternatively, the present invention support pillow 10 which is curved, light and flexible, may also be formed to have an inflatable inner cavity portion making it particularly suitable for travel. Additionally, while the illustrated embodiment of the present invention support pillow 10 depicts the two head support members 30, 40 formed unitary with the base portion 10, it is to be understood the two head support members 30, 40 may separately attach to base portion 20 through any know means (e.g., a Velcro assembly) so as to be adjustable relative to one another.

Figure 4:
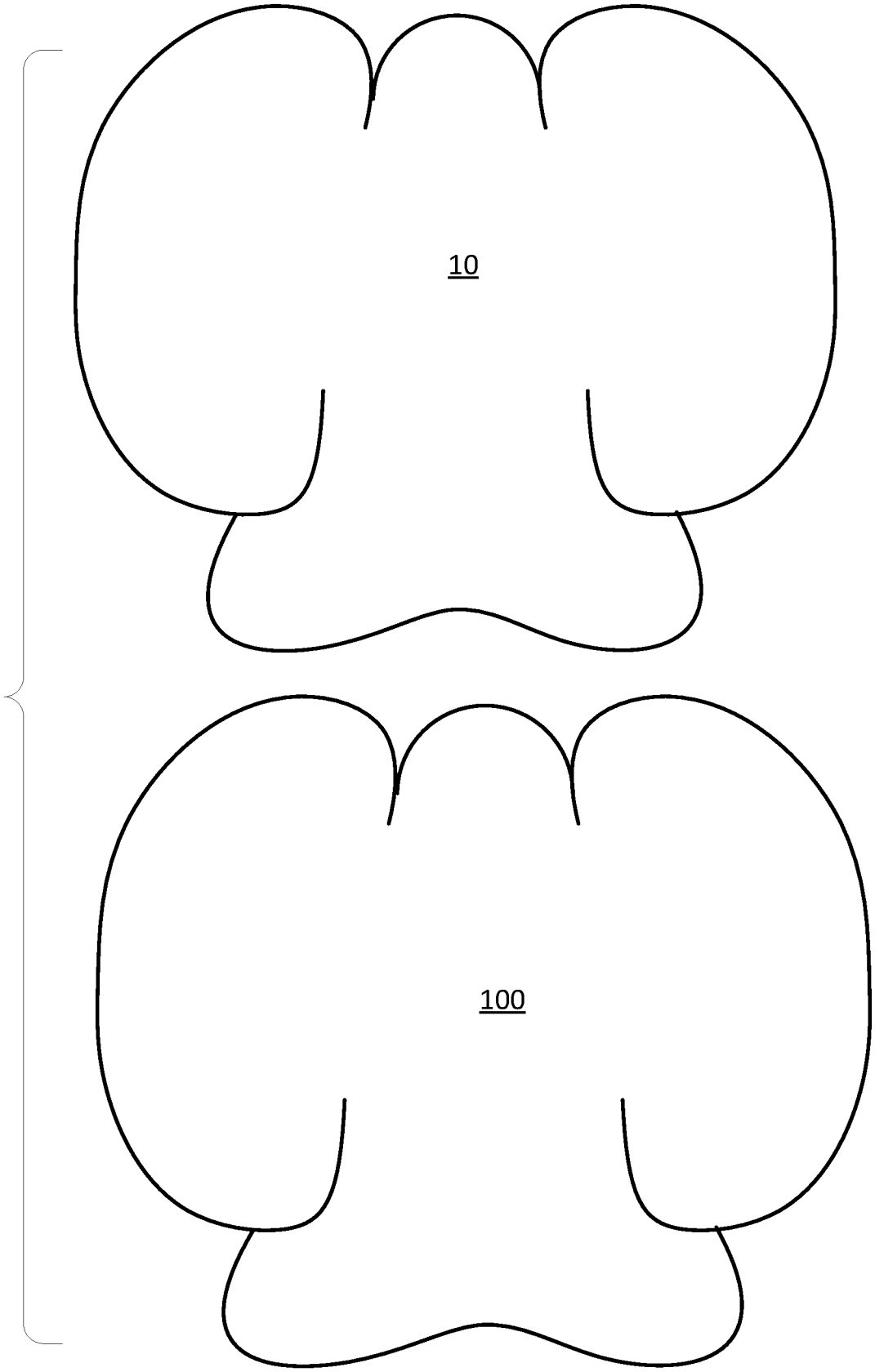
FIG. 4 is a disassembled view of the support pillow of FIG. 1.

As shown in FIG. 4, the support pillow 10 may include a removable fitted pillow cover 100. The fitted cover 100 may be formed of spandex or any suitable material including a lightly quilted cotton/polyester material having sufficient stretch qualities. An advantage of a fitted cover 100 it is separately washable and replaceable relative to the pillow 10.

With returning reference to FIGS. 1-3, the front edge portion 12 of the base portion 20 is provided with a flared shape (e.g., a partial triangular cross-section) 22 configured to the support to the top of the shoulder area of a person while lying on a back position. The back edge portion 14 of the base portion 20 is shape in a curved configuration. The base portion 20 preferably curves/slopes so as to round upward to a central portion 16 from each front 12 and rear edge portion 14.

With respect to each head support member (30, 40) they are shaped to have a crescent configuration and extend angularly from base portion 20, in opposing directions, so as to accommodate and form (envelope) to the shape of a person's head disposed therebetween to comfortably support a person's head while preventing the head from turning too far in either direction. As shown in FIGS. 1-3, the flared shaped 22 front edge portion 12 of the base 20 extends beyond a terminating front edge portion 32, 42 of each head supporting member 30, 40 while a terminating rear edge portion 34, 44 of each head supporting member 30, 40 lays in a plane substantially parallel to that of the rear edge portion 14 of the base 10.

With the present invention support pillow 10 being described above relative to an exemplary illustrated embodiment, it is to be appreciated it is advantageous in that the function of its shape (with its head supporting members) supports a head in a novel way to promote back-sleeping as well as for medical and cosmetic purposes. It is preferably supportive and soothing, flexible and light, can be rolled or folded, making it very transportable. It can be used by itself or placed on a regular pillow for additional elevation if required.

With certain illustrated embodiments described above, it is to be appreciated that various non-limiting embodiments described herein may be used separately, combined or selectively combined for specific applications. Further, some of the various features of the above non-limiting embodiments may be used without the corresponding use of other described features. The foregoing description should therefore be considered as merely illustrative of the principles, teachings and exemplary embodiments of this invention, and not in limitation thereof.

It is to be understood that the above-described arrangements are only illustrative of the application of the principles of the illustrated embodiments. Numerous modifications and alternative arrangements may be devised by those skilled in the art without departing from the scope of the illustrated embodiments, and the appended claims are intended to cover such modifications and arrangements.

What is claimed is:

1. A shaped pillow for supporting the head of a person to promote a back-resting position, the shaped pillow comprising:

a base portion having opposing front and rear edge portions, opposing first and second side peripheral portions and a central curved portion configured to round upward from the front and rear edge portions to support against a back of the person's head and wherein a front edge portion is configured to support against the top of the shoulder area of the person; and first and second opposing supporting members, respectively extending from the opposing first and second side end peripheral portions of the base portion wherein each first and second opposing supporting member is shaped with a crescent configuration which extends angularly and upwardly respectively from the opposing first and second side end peripheral portions of base portion whereby each first and second opposing supporting member is separated from one another such that a majority portion of the central curved portion of the base portion is disposed within a region extending between each crescent configured first and second supporting members, whereby a portion of each first and second supporting member respectively overlaps with the opposing first and second side peripheral portions of the base portion and wherein each first and second supporting members is configured to accommodate to a shape of the person's head and support the side region of the person's head so as to support the person's head while limiting the turning of the head while the back of the person's head is disposed adjacent the curved base portion;

wherein the base portion is formed with a flared configuration at the front edge portion dimensioned and configured to support against a top of a shoulder area of the person.

2. The shaped pillow of claim 1, wherein the base portion and the first and second opposing supporting members are contoured and rounded and wherein the flared configuration is triangular in cross-section.

3. The support pillow of claim 1, wherein the base portion and the two side portions comprise a unitary structure having a cavity in the base portion and the two side portions.

4. The support pillow of claim 1, wherein each of the base portion and the two side portions are filled with a filler; and wherein the filler is selected from the group of hypoallergenic polyester fibers, gel, padding, or inflatable media.

5. The support pillow of claim 1, wherein each of the two side portions is configured to support sideways movement of a head of the user so that the head remains in an upright, restful position while in back-sleeping or back-lying; wherein each of the base portion and the two side portions are filled with a filler; and wherein the filler comprises a firmness functional enough to support sideways movement of the head so that the head remains in the upright, restful position.

6. The support pillow of claim 1, further comprising a washable pillow covering.

7. The support pillow of claim 1, wherein the pillow is light and flexible enough to be folded and transported.

8. The support pillow of claim 1, wherein each of the two support portions is separately attachable to the base portion.

9. The support pillow of claim 1, wherein the base portion comprises a first cavity and each of the two support portions comprises a separate second cavity, each of the separate cavities being filled with a filler.

* * * * *